US009410411B2

(12) United States Patent
O'Malley et al.

(10) Patent No.: US 9,410,411 B2
(45) Date of Patent: Aug. 9, 2016

(54) METHOD FOR INDUCING AND FURTHER PROPAGATING FORMATION FRACTURES

(71) Applicant: Baker Hughes Incorporated, Houston, TX (US)

(72) Inventors: Edward J. O'Malley, Houston, TX (US); James G. King, Kingwood, TX (US); Paul Madero, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 551 days.

(21) Appl. No.: 13/800,331

(22) Filed: Mar. 13, 2013

(65) Prior Publication Data

US 2014/0262251 A1 Sep. 18, 2014

(51) Int. Cl.

| | |
|---|---|
| ***E21B 43/26*** | (2006.01) |
| ***E21B 33/127*** | (2006.01) |
| ***E21B 33/128*** | (2006.01) |
| ***E21B 33/12*** | (2006.01) |
| *E21B 33/00* | (2006.01) |
| *E21B 34/00* | (2006.01) |

(52) U.S. Cl.

CPC ..... *E21B 43/26* (2013.01); *E21B 33/127* (2013.01); *E21B 33/1208* (2013.01); *E21B 33/1277* (2013.01); *E21B 33/1285* (2013.01); *E21B 43/261* (2013.01); *E21B 2033/005* (2013.01); *E21B 2034/007* (2013.01)

(58) Field of Classification Search

CPC ..... E21B 33/1243; E21B 33/127; E21B 33/1277; E21B 33/1208; E21B 33/1285; E21B 2033/005; E21B 43/26; E21B 43/261; E21B 2034/007

USPC ..... 166/308.1

See application file for complete search history.

(56) References Cited

U.S. PATENT DOCUMENTS

| | | | | |
|---|---|---|---|---|
| 2,776,014 | A * | 1/1957 | Lee et al. | 166/177.5 |
| 2,798,560 | A | 7/1957 | Allen et al. | |
| 2,969,841 | A * | 1/1961 | Thomas | 166/243 |
| 4,655,286 | A | 4/1987 | Wood | |
| 5,295,393 | A | 3/1994 | Thiercelin | |
| 5,343,952 | A * | 9/1994 | Cowan et al. | 166/295 |
| 2006/0124310 | A1 * | 6/2006 | Lopez de Cardenas et al. | 166/313 |
| 2011/0139456 | A1 | 6/2011 | Montgomery | |
| 2011/0284229 | A1 | 11/2011 | Radmanovich et al. | |
| 2014/0284058 | A1 * | 9/2014 | Watson et al. | 166/308.1 |

* cited by examiner

*Primary Examiner* — Jennifer H Gay
*Assistant Examiner* — George Gray
(74) *Attorney, Agent, or Firm* — Steve Rosenblatt

(57) ABSTRACT

Fractures are induced from lobe shaped inflatable members disposed at different axial locations along a string with frac ports in the circumferential gaps between the lobes. The lobes are inflated by landing a ball on a seat on a sleeve that is initially shifted enough to expose a fill port on each lobe. The lobes are inflated to a pressure that initiates fractures in the formation as the lobes extend. Further raising the pressure induces the sleeve to move a second time to open frac ports. The annulus can be cemented and fracturing can penetrate the cement to further propagate the initiated fractures from lobe inflation. The process is repeated at different levels until the zone of interest is completed. Sensors can relay information by telemetry techniques as to the onset of fractures or other well conditions. The sleeve for the frac ports can be moved in a variety of ways without intervention tools.

19 Claims, 3 Drawing Sheets

METHOD FOR INDUCING AND FURTHER PROPAGATING FORMATION FRACTURES

FIELD OF THE INVENTION

The field of the invention is using inflatables to initiate formation fractures and further propagating the fractures with ports that are opening in gaps in or between inflatables.

BACKGROUND OF THE INVENTION

Fracturing is a performance enhancing technique where fractures are started in a variety of ways and in some cases further propagated and/or held open for ultimate production to the surface. Packers have been set in open hole as a technique to initiate fractures as described in US Publication 2011/0139456. However, this technique preferably used compression set packers and sliding sleeves 22 that were located uphole from each packer that could be selectively opened for production. Another design shown in US Publication 2011/0284229 showed a series of inflatable packers that incorporated sliding sleeves that were shifted with a shifting tool on a service string such as coiled tubing to open ports above the inflatable which fully encircled the production string. This design involved another trip in the hole to open the ports and positioning of the ports remotely from the packer since the inflatable fully surrounded the production string.

Other references with some relevance to the present invention include U.S. Pat. No. 2,798,560 and U.S. Pat. No. 4,655,286.

What is needed and offered by the present invention is a way to initiate the fractures while at the same time minimizing the distance between the frac port and the fracture initiation device. The inflatables envisioned for the present invention preferably are segmental leaving gaps in between so that the ports can be located between the preferably inflated segments that initiate propagation of the fractures. The use of such segments or lobes to initiate fracture also leaves gaps so that a cementing job can take place with the cement fully filling the annular space by flowing around the lobes. The frac ports are hydraulically operated so that an intervention string is not needed. Various sensors can be employed to transmit formation information to the surface to determine the onset of fractures. The fractures can occur through the ports opened by the sliding sleeves either in open hole without cementing or through the cement. Multiple stacks of lobes can be used with sleeve actuation devices that employ balls of progressively larger size as one way to actuate the sleeves in the order required. These and other features of the present invention will be more readily apparent to those skilled in the art from a review of the detailed description of the preferred embodiment and the associated drawings while recognizing that the full scope of the invention is to be found in the appended claims.

SUMMARY OF THE INVENTION

Fractures are induced from lobe shaped inflatable members disposed at different axial locations along a string with frac ports in the circumferential gaps between the lobes. The lobes are inflated by landing a ball on a seat on a sleeve that is initially shifted enough to expose a fill port on each lobe. The lobes are inflated to a pressure that initiates fractures in the formation as the lobes extend. Further raising the pressure induces the sleeve to move a second time to open frac ports. The annulus can be cemented and fracturing can penetrate the cement to further propagate the initiated fractures from lobe inflation. The process is repeated at different levels until the zone of interest is completed. Sensors can relay information by telemetry techniques as to the onset of fractures or other well conditions. The sleeve for the frac ports can be moved in a variety of ways without intervention tools.

Figure 6A:
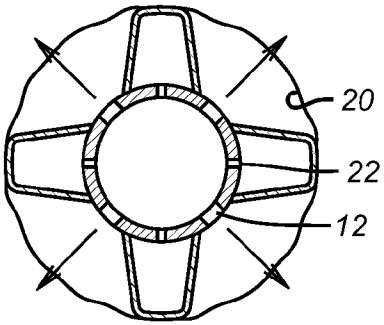
FIG. 6 is the view of FIG. 5 with the sleeve shifted a second time to open the ports to the formation.
Figure 6:
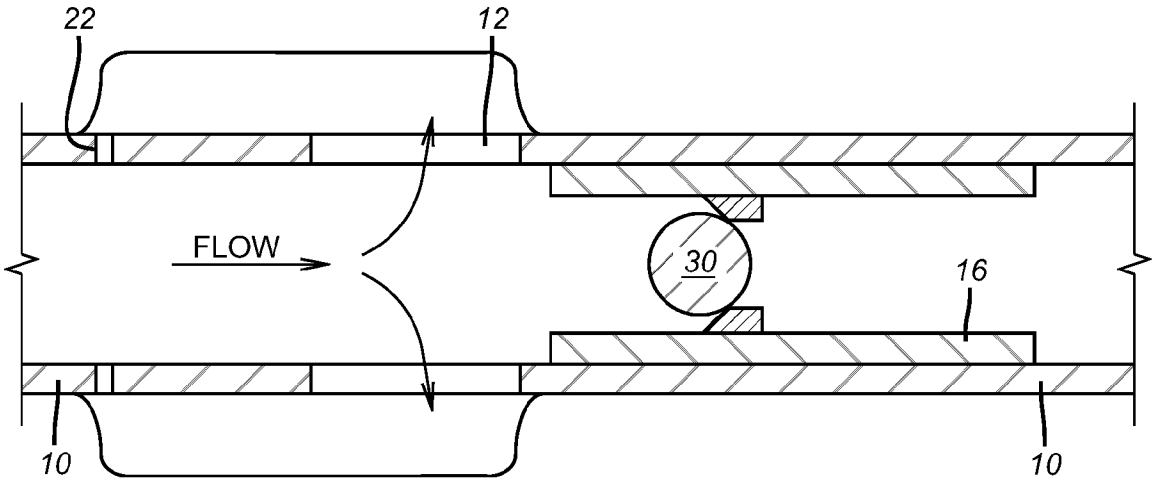
Figure 8:
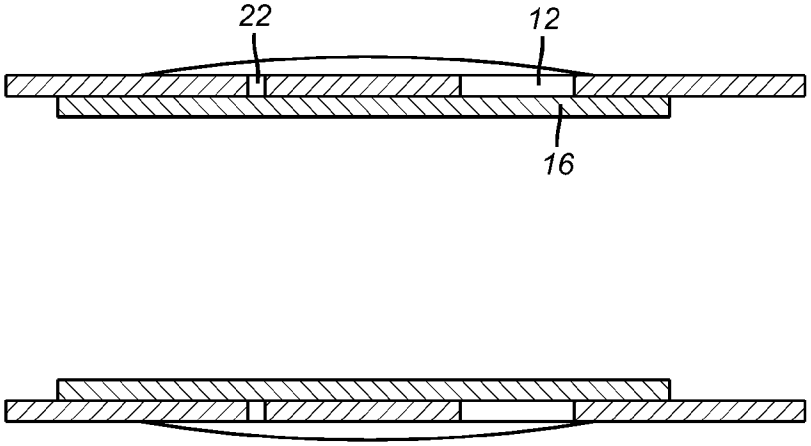
Figure 10:
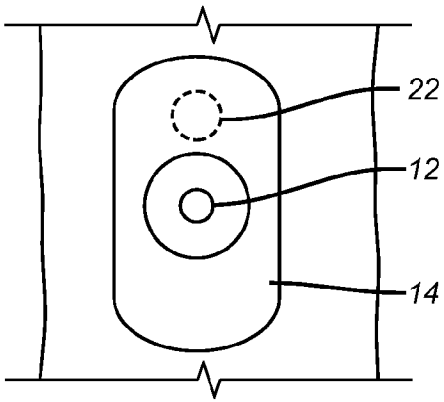
Figure 7:
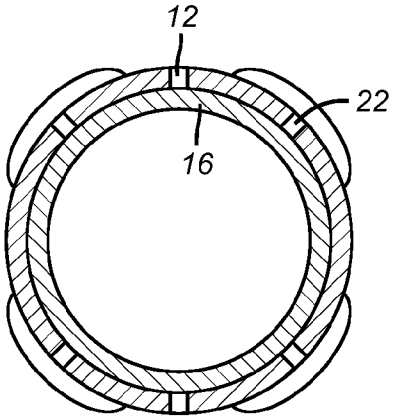
Figure 9:
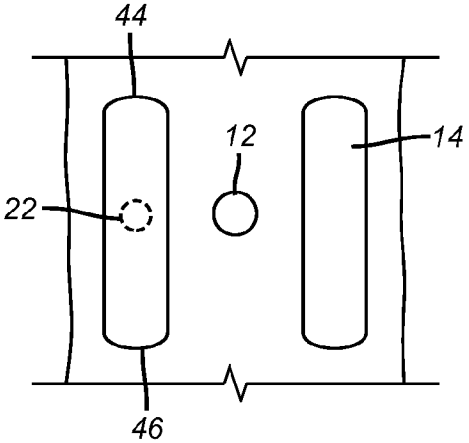

FIG. **6*a* is a section view through FIG. 6** showing the ports to the formation open;

FIG. 7 is and end view of the inner sleeve with the ports to the lobes and the formation closed;

FIG. 8 is an axial section view of the assembly shown in FIG. 7;

FIG. 9 is an external view of two adjacent lobes showing the port for formation access between the lobes; and FIG. 10 is an alternative embodiment to FIG. 9 with the formation port surrounded by the lobe.

DETAILED DESCRIPTION OF THE PREFERRED EMBODIMENT

Figure 1:
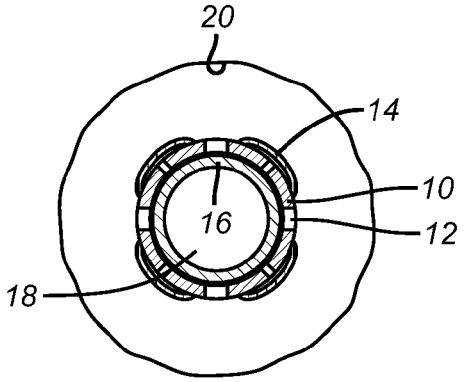
FIG. 1 is a section view of the assembly in a run in position.
Figure 2:
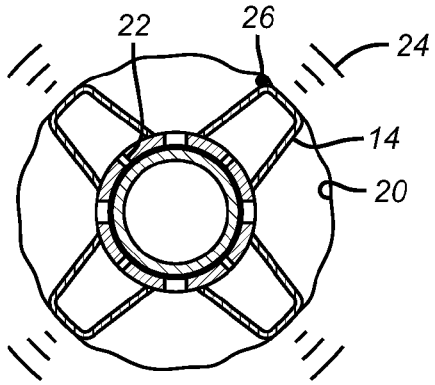
FIG. 2 is the view of FIG. 1 with the lobes extended.
Figure 3:
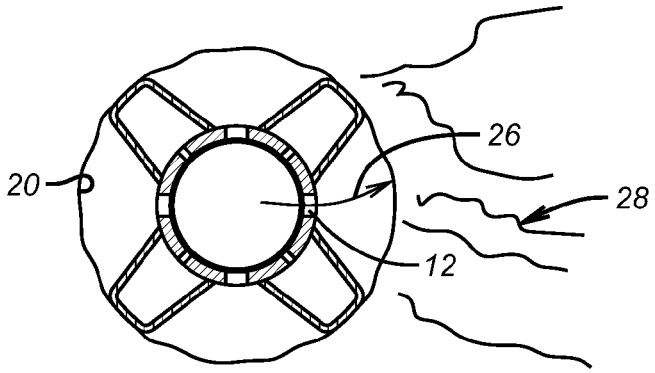
FIG. 3 is the view of FIG. 2 with the sleeve shifted to open access ports between the lobes for fracture extension.

FIG. 1 illustrates the main components of the assembly. A mandrel 10 has ports 12 disposed between inflatable lobes 14. A sliding sleeve 16 isolates internal passage 18 from the lobes 14 and ports 12 for run in. The sleeve 16 is preferably operated without well intervention such as by applied pressure from the surface of the open borehole 20 that is preferably horizontal for the deployment of the illustrated assembly. The method features opening access to the lobes 14 through ports 22 as shown in FIG. 2. This is accomplished with an initial translation of the sleeve 16 that is accomplished without well intervention. In FIG. 2 the lobes 14 are inflated and in contact with the borehole 20 wall so that fractures 24 are initiated as pressure inside the lobes 14 is increased. Instruments 26 sense the onset of fracture formation and through known telemetry techniques transmit the information to the surface to alert surface personnel to take steps to move sleeve 16 so that ports 12 can be opened for propagating the fracture started by inflation of the lobes 14. This is shown in FIG. 3 where the ports 12 are open and fluid exits those ports very near the location where the fractures 24 started on expansion of lobes 14. The flow represented by arrow 26 increases the initial fractures 24 as represented by 28.

Figure 4:
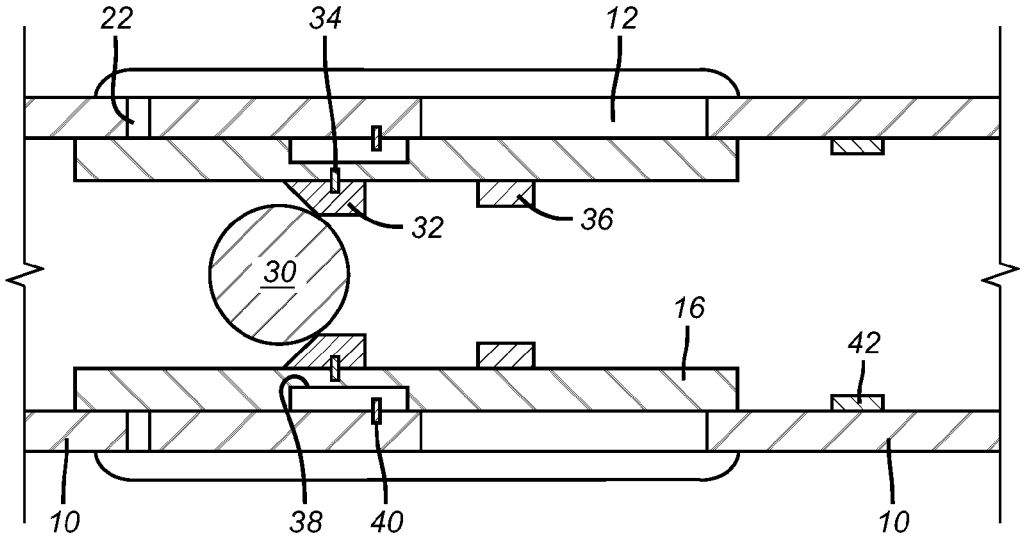
FIG. 4 shows a hydraulically operated inner sleeve in a run in position where ports to the lobes and to the formation are both closed.

FIG. 4 illustrates the sequence of movement of sleeve 16 to first allow inflation of lobes 14 by opening ports 22. One way this can be done is to drop a ball 30 on seat 32 and build pressure to break shear pins 34. The sleeve 16 moves to the right to expose ports 22 so that lobes 14 can inflate. Seat 32 is eventually stopped at shoulder 36. Slot 38 on the exterior of sleeve 16 allows initial movement of sleeve 16 without breaking shear pin 40 which stops the sleeve 16 with only ports 22 open. After the fractures 24 are initiated the shear pin 34 is sheared and pressure is further built up to further move the sleeve 16 to open the ports 12 so that the fractures 24 can be further propagated as shown at 28. The seat 32 is captured by shoulder 36. The second movement of sleeve 16 opens the ports 12 as the shear pin 40 is broken ultimately allowing the stop/lock 42 to capture the sleeve 16 in the position where ports 22 and 12 are all open.

Other ways to get the ports open without intervention are contemplated. For example a j-slot tied to a ball landed on a seat can be employed so that the first pressure cycle opens ports 22 and the second pressure cycle opens ports 12. Progressively larger balls can be used to address multiple axially spaced locations for otherwise identical assemblies so that an entire desired zone can be fractured. The ability to manage each assembly in turn without running an intervention string into the borehole speeds up the process so as to reduce rig time and associated costs.

Figure 5:
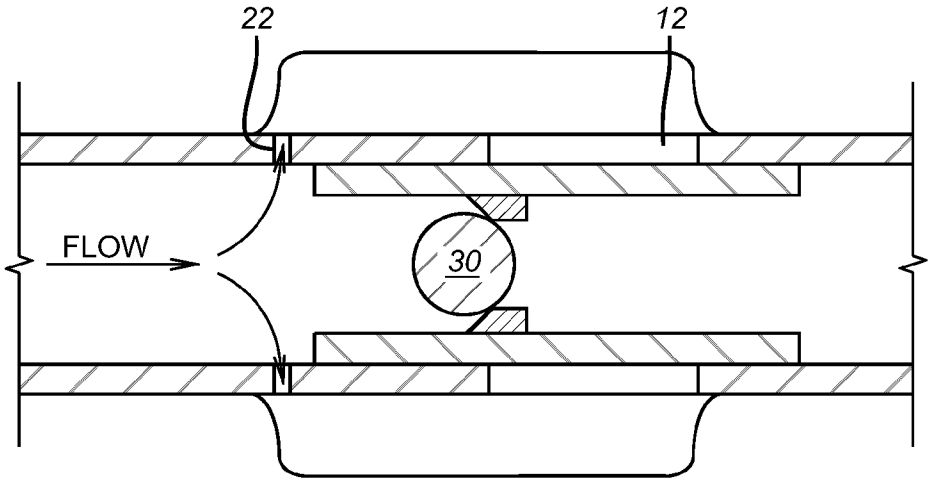
FIG. 5 shows the first movement of the sleeve of FIG. 4 to allow access to the lobes to inflate them.

FIGS. 5 and 6 schematically illustrate the dual movement of sleeve 16 to initially open the ports 22 and then to open the ports 12. Ports 12 are circumferentially rotated from the lobes 14 so that they provide direct access to the formation at the borehole wall 20 as shown in FIG. 6*a*. FIGS. 7 and 8 are similar to FIGS. 1 and 4 and are somewhat schematic for the run in position taking note that the ports 12 are not literally under a lobe 14 but offset from ports 22 that are used to extend the lobes 14.

FIG. 9 shows an elongated lobe 14 layout with the ports 12 located between upper ends 44 and lower ends 46 of the lobes 14. This puts the ports 12 as close as possible to the initiated fractures 24 started by lobe 14 inflation, as shown in FIG. 2. In FIG. 10 the lobe 14 surrounds the port 12 so that the flow to enhance the initiated fractures 24 comes out right at the initiation location caused by inflation of the lobes 14.

Those skilled in the art will appreciate that the mandrel 10 can be part of a production string that can be left in open hole for production or can be cemented with lobes 14 expanded and the pressure of fluid through ports 12 will work its way through the cemented surrounding annulus to operate in the above described manner. The spacing of the lobes allows cement to pass around them when inflated. Later when the cement is set up removal of pressure internally at passage 18 allows the lobes to collapse to provide greater access to the ports 12 for production. Optionally the sliding sleeve can have screened openings that align with ports 12 after fracture enhancement to allow screening of production or injection flow, depending on the intended application. Preferably the cement is added with the lobes inflated but not to the degree that the fractures initiate. Rather, the lobes are further inflated after cementing to initiate the fractures with the wall ports opening to propagate the fractures. The lobe can be deflated by the frac fluid pumped through the wall ports.

The lobes can have a variety of shapes that are designed to contact the borehole wall to initiate fractures. The lobes can be inflatables or shapes that are compressed to contact the borehole wall to initiate fractures using an actuation method that requires no intervention. For example pressure can trigger selective pistons in a desired sequence controlled by such elements as rupture discs. Gaps between lobes allow cement to pass in cementing situations and allow location of frac ports to enhance the initiated fractures to be right at or very close to the initiated fractures by locating such frac ports between lobes or allowing lobes to surround the frac outlets.

The above description is illustrative of the preferred embodiment and many modifications may be made by those skilled in the art without departing from the invention whose scope is to be determined from the literal and equivalent scope of the claims below:

We claim:

1. A fracturing method for a borehole in a subterranean location, comprising:

providing a string with circumferentially spaced extendable lobes oriented axially along said string and a plurality of selectively opened adjacent wall ports, said wall ports located between upper and lower ends of said adjacent lobes;

configuring said lobe to leave at least one gap oriented axially along said string in an annular space surrounding said string when said lobes are extended;

locating said string at a desired location for fracturing;

extending said lobes into a borehole wall to apply force to the borehole wall to initiate fractures with an initial movement of a valve member that opens at least some said wall ports;

mechanically stopping said valve member from further movement beyond said initial movement;

selectively opening other said ports after said valve member initial movement by defeating said mechanically stopping to apply fluid pressure to the borehole wall to propagate the initiated fractures.

2. The method of claim 1, comprising:

opening said port without intervention in the borehole.

3. The method of claim 1, comprising:

using a plurality of circumferentially spaced lobes as said at least one lobe.

4. The method of claim 3, comprising:

locating said port between a top and bottom of spaced adjacent lobes.

5. The method of claim 1, comprising:

using pressure in said string to open said wall port.

6. The method of claim 1, comprising:

inflating said lobe with an inflation port.

7. The method of claim 6, comprising:

opening said inflation port before said wall port.

8. The method of claim 7, comprising:

using pressure to move said sleeve.

9. The method of claim 8, comprising:

landing an object on a seat in said sleeve;

pressuring up on said object to initially move said sleeve to expose said inflation port.

10. The method of claim 9, comprising:

raising or cycling pressure to make said sleeve move a second time to expose said wall port.

11. The method of claim 1, comprising:

providing said plurality of circumferentially spaced lobes at a plurality of spaced axial locations with a plurality of wall ports in circumferential gaps between lobes at each axial location;

sequentially extending lobes and opening wall ports to initiate and propagate fractures over a zone of interest.

12. The method of claim 11, comprising:

providing a sleeve at each spaced axial location;

using each sleeve to open inflation ports to extend lobes at each axial location and then to expose wall ports located between or surrounded by said lobes.

13. The method of claim 12, comprising:

moving said sleeves with pressure in said string.

14. The method of claim 13, comprising:

using seats of different sizes at discrete axial locations;

dropping objects of increasing dimension to sequentially shift sleeves at different axial locations in a zone of interest.

15. The method of claim 11, comprising:

flowing cement through said circumferential gaps formed by said extended lobes.

16. A fracturing method for a borehole in a subterranean location, comprising:

providing a string with circumferentially spaced extendable lobes oriented axially along said string and a plurality of selectively opened adjacent wall ports, said wall ports located between upper and lower ends of said adjacent lobes;

configuring said lobe to leave at least one a gap oriented axially along said string in an annular space surrounding said string when said lobes are extended;

locating said string at a desired location for fracturing;

extending said lobes into a borehole wall to apply force to the borehole wall to initiate fractures;

opening said port after said extending to apply fluid pressure to the borehole wall to propagate the initiated fractures;

overlapping said port with said lobe.

17. The method of claim 16, comprising:

directing flow to enhance the initiated fractures by said lobes to come out at the initiation location caused by inflation of said lobes.

18. A fracturing method for a borehole in a subterranean location, comprising:

providing a string with at least one extendable lobe and at least one selectively opened adjacent wall port;

configuring said lobe to leave a gap in an annular space surrounding said string when said lobe is extended;

locating said string at a desired location for fracturing;

extending said lobe into a borehole wall to apply force to the borehole wall to initiate fractures;

opening said port after said extending to apply fluid pressure to the borehole wall to propagate the initiated fractures;

providing a plurality of circumferentially spaced lobes at a plurality of spaced axial locations with a plurality of wall ports in circumferential gaps between lobes at each axial location;

sequentially extending lobes and opening wall ports to initiate and propagate fractures over a zone of interest;

flowing cement through said circumferential gaps formed by said extended lobes;

further increasing pressure in said lobes to initiate fractures after flowing cement.

19. The method of claim 18, comprising:

deflating said lobes when opening said wall ports for fracture propagation.

* * * * *